United States Patent [19]

Nilsson

[11] 3,982,339

[45] Sept. 28, 1976

[54] REVERSIBLE SLIDE-ON DIGGER TOOTH WITH EASY REMOVAL ARRANGEMENT

[76] Inventor: Lennart Nilsson, 12232 Enskede, Stockholm 45, Sweden

[22] Filed: Feb. 24, 1975

[21] Appl. No.: 552,564

[30] Foreign Application Priority Data

Jan. 20, 1975 Norway ..... 160/75

[52] U.S. Cl. ..... 37/141 T; 37/142 R

[51] Int. Cl.[2] ..... E02F 9/28

[58] Field of Search ..... 37/141 R, 141 T, 142 R, 37/142 A

[56] References Cited

UNITED STATES PATENTS

| | | | |
|---|---|---|---|
| 1,169,229 | 1/1916 | Bimson | 37/142 R |
| 1,216,290 | 2/1917 | Dickson | 37/142 R |
| 1,270,670 | 6/1918 | Stone | 307/142 R |
| 1,419,047 | 6/1922 | Hanks et al. | 37/142 R |
| 1,772,624 | 8/1930 | Brendlin | 37/141 R |
| 2,118,872 | 5/1938 | Weimer | 37/142 R |
| 2,982,035 | 5/1961 | Stephenson | 37/142 R |
| 3,694,827 | 11/1971 | Liess et al. | 37/142 R |
| 3,839,805 | 10/1974 | Stepe | 37/142 R |
| 3,841,007 | 10/1974 | Howarth et al. | 37/141 R |

*Primary Examiner*—Edgar S. Burr
*Assistant Examiner*—R. E. Suter
*Attorney, Agent, or Firm*—Cushman, Darby & Cushman

[57] ABSTRACT

A tooth for a loading or excavating bucket includes a support member connectable to the edge of the bucket and a replaceable wedge-shaped slide-on cap. The front portion of the support member is inclined with respect to the rear portion, and the latter can be connected to the bucket in either of two positions 180° apart so that the front portion and the slide-on cap can be disposed in either of two corresponding positions.

2 Claims, 3 Drawing Figures

REVERSIBLE SLIDE-ON DIGGER TOOTH WITH EASY REMOVAL ARRANGEMENT

Figure 1:
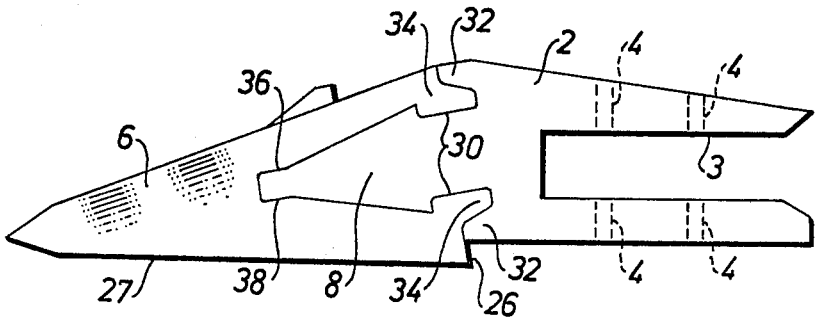

The present invention relates to a tooth for a loading or excavating bucket.

It is often desired that the front edge of a bucket of a bucket loader or an excavating machine should be provided with teeth, which then should be replaceable, since they are exposed to extensive wear. The number of teeth can vary but most frequently will be approximatly 10. In order to illustrate the wear, it might be mentioned as an example that in a bucket loader operating with rock loading the normal life of the bucket teeth may be considered to be about three weeks.

When the teeth are worn out, they must be replaced. It is thus now usual that the bucket teeth comprise two members, viz., a support member secured to the front terminal edge of the bucket and a slide-on member, which is adapted to be slid onto the support member. Hereby the replacement of worn-out teeth is facilitated considerably, since only the slide-on member need be replaced, which eliminates the previously occurring disadvantages of teeth formed in one piece, resulting from the fact that the teeth have to be cut loose from the bucket edge due to the deformations caused during the operation of the bucket.

Experience has also shown that in prior teeth with a replaceable slide-on member, the bolt connecting the slide-on member with the support member is exposed to large stresses, and the head thereof must be cut lose in order to enable the replacement of the slide-on member. In a tooth recently introduced this disadvantage has been avoided by dimensioning the leg carrying the wear surface of the slide-on member as well as the countersink, in which the head of the bolt is located, such that, when the wear surface has been worn down to the bottom of said countersink, the slide-on member shall be ready to be replaced.

Both in bucket loaders and excavating machines the wear surface in operation is the surface of the slide-on member, which is normally directed towards the ground. It has then been experienced that in bucket loaders the wear surface should extend substantially in parallel to the bottom side of the attached bucket part, while in excavating machines it should be directed at an angle from the tangential plane to the bottom side of the bucket in order to obtain best results.

One object of the present invention is to provide a tooth of the kind mentioned above, which is useable both in connection with loading buckets and excavating buckets.

This object has been attained by a tooth for a loading or excavating bucket, said tooth having a slide-on member and comprising a support member for supporting the slide-on member.

The slide-on member has a first wear surface and a second surface opposite thereto and forming with said wear surface a wedge like front portion of said slide-on member, said slide-on member having further a rear portion having between said first and second surfaces two legs separated by a recess.

The support member has a front portion engaging with said recess and two shoulders engaging with the ends, respectively, of said legs, and a rear portion having two opposite surfaces extending from said shoulders. The rear portion also has means for securing the support member to a forward terminal edge portion of the bucket, the securing means including two legs defining a recess for receiving the terminal edge portion.

The recess of said slide-on member and said front portion of said support member are symmetrical with respect to a first centre plane between the legs of the slide-on member to allow the slide-on member to be supported by the support member with said wear surface located on either side of said first plane, said first plane further extending at an angle to a second centre plane between the legs of the support member such that the inclination of said wear surface to said second plane when on one side of said first plane differs from the inclination of the wear surface when on the other side of the first plane. A bolt extends through said legs of said slide-on member and said front portion of said support member and has an enlarged end member located in a countersink in said wear surface, the bottom of said countersink being substantially on a level with the nearest one of said opposite surfaces of said rear portion of said support member at the corresponding shoulder, independently of the location of the wear surface with respect to the first plane.

One of the advantages of the invention is that one and the same tooth can be used both in connection with loading buckets and in connection with excavating buckets. In the first case the support member is mounted in such a position that the wear surface extends substantially in parallel with the bottom side of the bucket, while in the second case the support member is mounted in a reversed position, so that the wear surface is located at an angle with the tangential plane of the bottom side of the bucket.

Figure 2:
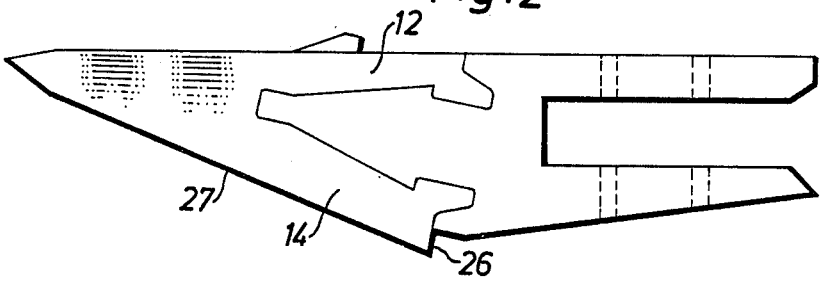
Figure 3:
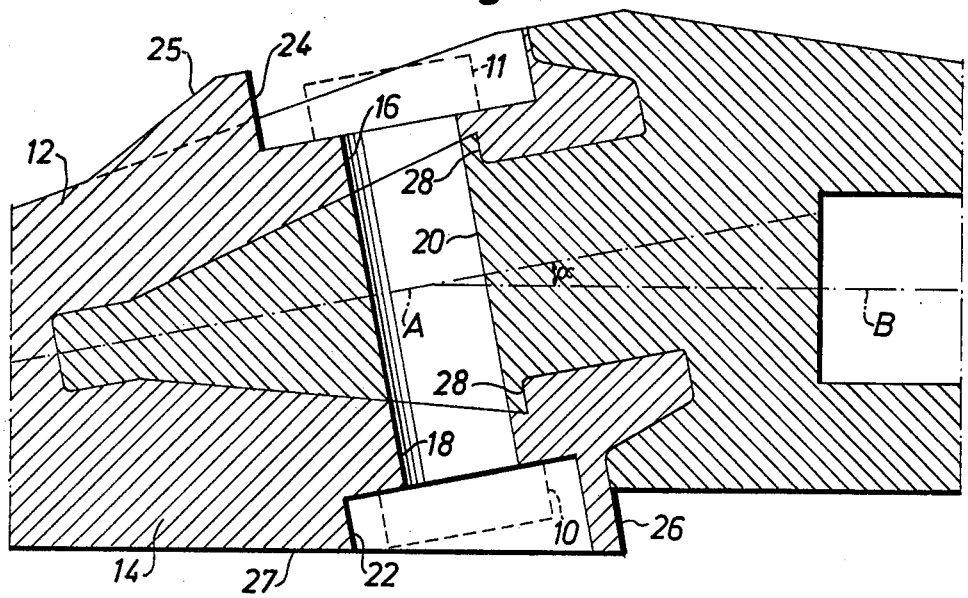

One embodiment of the invention will now be described more closely with reference to the accompanying drawing, on which FIGS. 1 and 2 show the same tooth, with the wear surface thereof in both cases directed downwards but with the support member located in two different positions, and FIG. 3 at an enlarged scale shows a longitudinal cross section through a central portion of the tooth in the position illustrated in FIG. 1.

The tooth shown on the drawing has a support member 2, having a slot 3 and bolt connections, indicated at 4, by means of which the tooth support 2 is put on and secured to the front edge of a loading or excavating bucket, now shown. The support member 2 further carries a slide-on member 6, which is adapted to be slid onto the support 2 laterally. The surfaces of the support 2 and the slide-on member 6, which are matched to each other, are provided with a profile such as to secure the best possible fixing of the slide-on member 6 on the support 2. To this end the support 2 has an end portion, generally referenced 8, extending into the slide-on member 6 and substantially tapering with the wedge shaped tapering of the slide-on member. A bolt, of which only the head and nut portions are indicated by means of dotted lines at 10 and 11 in FIG. 3, extends through the two legs 12 and 14 of the slide-on member 6 and the support 2 through aligned bores 16, 18 and 20 in the slide-on member and the support member, respectively. The lower leg of the slide-on member 14 has a countersink 22 for the lower bolt head or nut 10 and the upper leg of the slide-on member has a corresponding countersink 24, in front of which a protective lug 25 for the bolt head or nut 11 is located. The leg 14, and more specifically the thickness thereof, is dimensioned, by having a shoulder 26, such that when the lower side thereof, which forms the wear surface 27 of the tooth, has been worn down substantially to the bottom of the countersink 22, the slide-on member will be ready to be replaced. Since the head or nut 11 has then likewise been worn down, this replacement can be performed in a very simple manner only by knocking the bolt out.

The end portion 8 of the support has a narrower neck portion 30 formed by shoulders 28 and wedge shaped shoulders 32 directed towards the front end of the tooth. The ends 34 of the legs of the slide-on member are shaped so as to engage with the recesses each formed by a shoulder 28, the neck portion 30 and a shoulder 32. The end of the support member 8 has support surface portions 36 and 38 which in operation assist in reducing the load on the connecting bolt.

The surface portions of the slide-on member and the support member, respectively, engaged with each other are located symmetrically relative a first centre plane A extending in parallel with the slide-on direction of the slide-on member onto the support member i.e. extending between the legs of the slide-on member. Further, the plane A forms an angle $\alpha$ with a second center plane B between the legs of the support member. This arrangement permits the different working positions of the slide-on member as shown in FIGS. 1 and 2, respectively, by turning the support 180°. The working position shown in FIG. 1 is then preferably adapted for loading buckerts, while the position according to FIG. 2 preferably is adapted for excavation buckets. In the former case the wear surface 27 of the tooth extends substantially in parallel with or at a very small angle to a tangential plane of bottom side of the bucket, while in the latter case the wear surface forms a relatively large angle with said tangential plane.

The support can also be provided at one side with a side wall, not shown more, which only allows sliding-on of the slide-on member from one side, but causes a stabilization and reinforcement of the mounted tooth. Instead of a side wall of the support member the slide-on member may be provided with a corresponding side wall having the same function.

What I claim is:

1. A tooth for a loading or excavating bucket, said tooth having a slide-on member and a support member for supporting said slide-on member; said slide-on member having a first wear surface and a second surface opposite thereto and forming with said wear surface a wedge-like front portion of said slide-on member, said slide-on member having further a rear portion having between said first and second surfaces two legs separated by a recess; said support member having a front portion engaging with said recess and two shoulders engaging with the ends, respectively, of said legs, and a rear portion having two opposite surfaces extending from said shoulders, said rear portion further having means for reversibly securing said support member to a forward terminal edge portion of a bucket with either of said opposite surfaces turned upwards relative to said bucket, said securing means comprising two legs defining a recess for receiving said terminal edge portion; said recess of said slide-on member and said front portion of said support member being symmetrical with respect to a first centre plane between said slide-on member legs to allow the slide-on member to be supported by the support member with said wear surface always facing downwards relative to said bucket although said support member has been reversed on said edge portion, depending upon the relative location of said opposite surfaces of said rear portion on said forward terminal edge portion, said first plane further extending at an angle to and intersecting a second centre plane between said support member legs such that the inclination of said wear surface to said second plane when on one side of said first plane, differs from the inclination of the wear surface, when on the other side of the first plane; a bolt extending through said legs of said slide-on member and said front portion of said support member and means for facilitating replacement of said slide-on member comprising a countersink in said wear surface, said bolt having an enlarged end member located in said countersink, the bottom of said countersink being substantially in the plane of either of said opposite surfaces of said rear portion of said support member at the corresponding shoulder when either surface is disposed adjacent the wear surface, whereby when the wear surface has been worn down to the bottom of said countersink, the enlarged end of said bolt will also be substantially worn away, enabling easy removal of said bolt and replacement of said slide-on member.

2. A tooth according to claim 1, wherein the wear surface when said support member is in one position with respect to said edge portion extends substantially parallel to said second plane and when said support member has been reversed is inclined towards said second plane.

* * * * *